US005533222A

United States Patent [19]

Lelkes et al.

[11] Patent Number: 5,533,222

[45] Date of Patent: Jul. 9, 1996

[54] FLOOR AND BASEBOARD TREATMENT MACHINE

[76] Inventors: Anthony Lelkes, 21 Loganberry Cres., Willowdale, Ontario, Canada, M2H 3H3; Larry Reid, 60 Cassandra Blvd., Unit #8, Don Mills, Ontario, Canada, M3A 1S6

[21] Appl. No.: 495,874

[22] Filed: Jun. 28, 1995

Related U.S. Application Data

[63] Continuation-in-part of Ser. No. 412,783, Mar. 28, 1995, abandoned.

[51] Int. Cl.[6] ..... A46B 13/02; A47L 11/16

[52] U.S. Cl. ..... 15/4; 15/230; 15/230.14; 15/230.17; 15/230.18; 451/353; 451/359

[58] Field of Search ..... 15/4, 23, 49.1, 15/52, 230, 230.14, 230.17, 230.18, 230.19; 451/350, 353, 354, 359

[56] References Cited

U.S. PATENT DOCUMENTS

| | | | |
|---|---|---|---|
| 3,067,549 | 12/1962 | Laverdisse | 15/230.17 |
| 3,100,905 | 8/1963 | Salick | 15/230.19 |
| 3,280,415 | 10/1966 | Moore | 15/4 |
| 3,307,211 | 3/1967 | Gaines | 15/4 |
| 3,357,141 | 12/1967 | Annis, Jr. | 15/230.14 |
| 3,527,001 | 9/1970 | Kleemeier | 15/230.17 |
| 3,703,739 | 11/1972 | Young | 15/230.17 |
| 3,882,644 | 5/1975 | Cusumano | 451/359 |
| 4,282,623 | 8/1981 | Gacuzana | 15/230.17 |
| 4,910,826 | 3/1990 | Rones | 15/230 |
| 5,432,970 | 7/1995 | Reid | 15/49.1 |

*Primary Examiner*—David Scherbel
*Assistant Examiner*—Randall E. Chin
*Attorney, Agent, or Firm*—Jane Parsons

[57] ABSTRACT

A floor machine for cleaning a floor and/or wall and/or downward upstanding from the wall, includes at least one disc having a floor cleaning pad covering a lower surface and wall cleaning material projecting from its periphery. The wall cleaning material may be bristles or a wrap-around separate strip of abrasive felted material, or a margin of the floor cleaning pad may be bent upwardly to form a vertical cylindrical surface. Alternatively, floor pads may be stacked to present a vertical cylindrical wall cleaning surface. The disc may be engaged with a drive shaft, or stacked discs may interengage with each other, the topmost being engaged with the drive shaft. The bottom disc may have a bevel rising from the lower surface. Bristles extend from the bevel at right angles. When the floor machine rests on the floor in operation position, the bristles extending from the bevel are bent upwardly to be forced towards the angle between floor and wall.

14 Claims, 13 Drawing Sheets

FLOOR AND BASEBOARD TREATMENT MACHINE

RELATED APPLICATION

This application is a continuation-in-part of U.S. patent application Ser. No. 08/412,783, filed Mar. 28, 1995, now abandoned in the names of the same two inventors. The previous application is abandoned as of the filing of the instant application.

BACKGROUND OF THE INVENTION

1. Field of the Invention

The invention relates to floor machines for waxing, stripping or otherwise treating floors by means of rotating brushes, pads or other means for treating the floor. Especially, the invention relates to floor machines for cleaning floors utilising a rotating pad combined with means for cleaning baseboard.

2. Acknowledgement of Prior Art

Floor machines for commercial, industrial heavy duty use for stripping, washing or otherwise treating the surface of a floor by rotating treatment discs are well known. Generally, they comprise an electric motor for rotating the treatment means and have a handle so that they may be operated by a standing operator. Such machines will be referred to herein as "floor machines".

Floor machines intended for heavy duty use often comprise a single, circular, abrasive pad attached to the motor of the machine through a support disc and a vertical drive shaft through the centre of the disc. The floor machine is usually provided with a protective covering hood, covering the pad and support disc from above. When the floor machine is intended for use to clean baseboard or vertical wall surface in addition to the floor, any surface and having an upper pad surface flush with said lower surface, and vertical surface cleaning means extending radially outward from said cylindrical vertical wall for cleaning said vertical surface adjacent the floor.

The vertical surface cleaning means for example may be, baseboard cleaning means, outwardly extending bristles or a felted abrasive pad wrapped about said cylindrical vertical wall and secured thereto, or flaps of fabric or even the side edges of stacked circular base pads.

Conveniently, the engagement means between the drive shaft and the treatment unit may comprise a plurality of drive shaft lugs on the drive shaft engaging a corresponding plurality of mating unit lugs on the treatment unit.

The floor disc may have other discs stacked above it to increase the height of the treatment unit. These other discs are of similar circumference to that of the floor disc and also have bristles extending radially outward.

Preferably, the floor disc is provided with a bevelled surface between the shallow vertical wall and the lower surface, bristles extending form the bevelled surface at right angles thereto to extend radially and slightly downwardly from the lower surface. The floor treatment pad extends under the bristles so that its margin is biassed downwardly. In use, this may have the effect of forcing bristles and/or treatment pad into the angle between the floor and vertical surface such as baseboard.

The bevelled surface suitably extends outwardly and upwardly from the lower surface at substantially 20° thereto. lower surface, and vertical surface cleaning means extending radially outward from said cylindrical vertical wall for cleaning said vertical surface adjacent the floor.

The vertical surface cleaning means for example may be, baseboard cleaning means, outwardly extending bristles or a felted abrasive pad wrapped about said cylindrical vertical wall and secured thereto, or flaps of fabric or even the side edges of stacked circular base pads.

Conveniently, the engagement means between the drive shaft and the treatment unit may comprise a plurality of drive shaft lugs on the drive shaft engaging a corresponding plurality of mating unit lugs on the treatment unit.

The floor disc may have other discs stacked above it to increase the height of the treatment unit. These other discs are of similar circumference to that of the floor disc and also have bristles extending radially outward.

Preferably, the floor disc is provided with a bevelled surface between the shallow vertical wall and the lower surface, bristles extending form the bevelled surface at right angles thereto to extend radially and slightly downwardly from the lower surface. The floor treatment pad extends under the bristles so that its margin is biassed downwardly. In use, this may have the effect of forcing bristles and/or treatment pad into the angle between the floor and vertical surface such as baseboard.

The bevelled surface suitably extends outwardly and upwardly from the lower surface at substantially 20° thereto.

The lower surface of the floor disc may be studded for intimate contact with the floor pad.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 1:
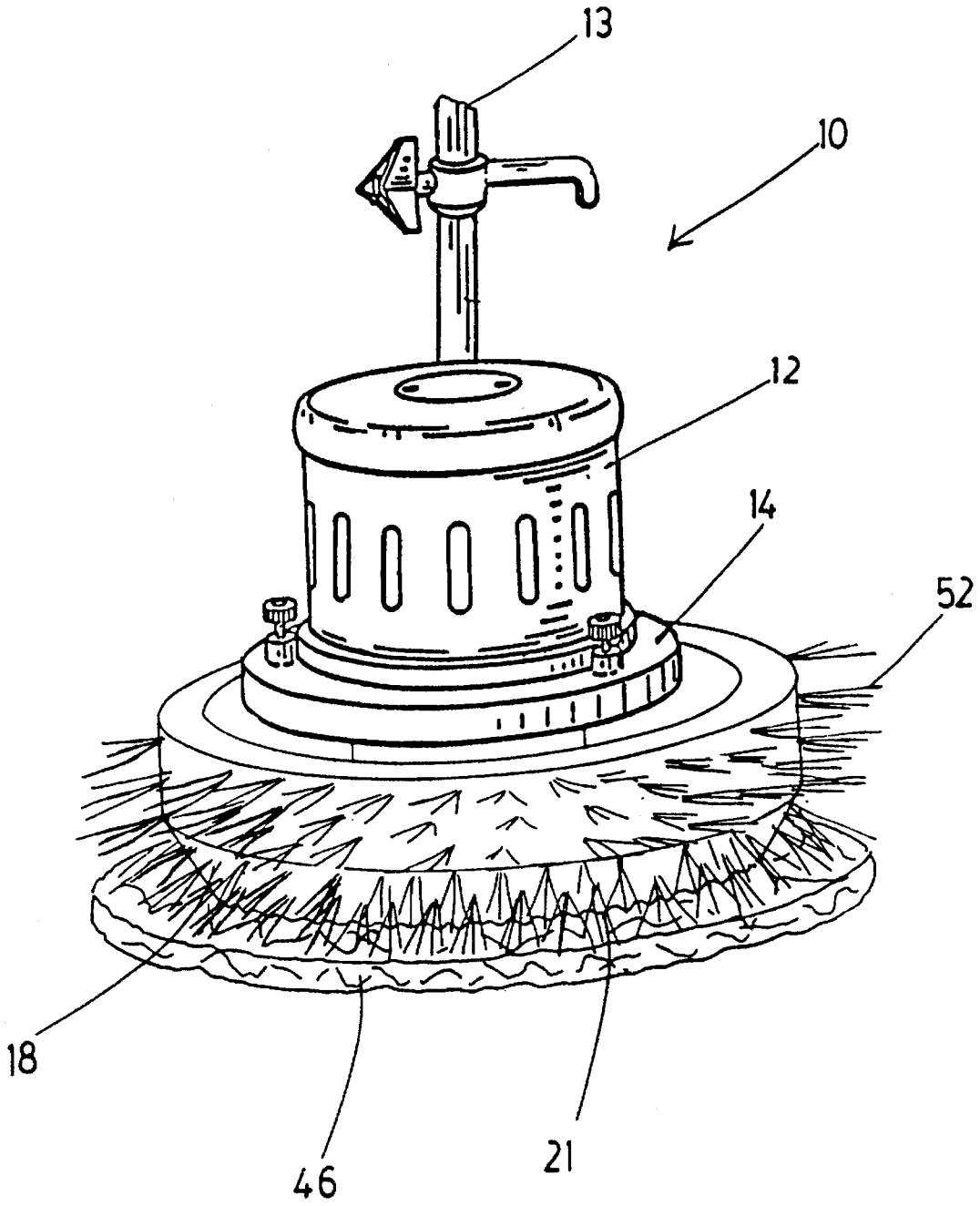
FIG. 1 shows an illustration is a view of a floor machine according to the invention having a single base disc.

Referring first to FIG. 1, a floor machine 10 comprises a motor housing 12 for an electric motor. A handle 13 extends upwardly from the collar 14 and is hinged to the machine for manual operation. The anchor collar 14 supports housing 12. The present invention may be used with the floor machine disclosed and claimed in U.S. patent application Ser. No. 08/180,905, now U.S. Pat. No. 5,432,970 previously referred to. A floor treatment base disc 18 is detachably connectable to a drive shaft 20. The base disc 18 is connected to the drive shaft 20 through interacting lugs 22 of the drive shaft and lugs 24 of the disc.

Figure 2:
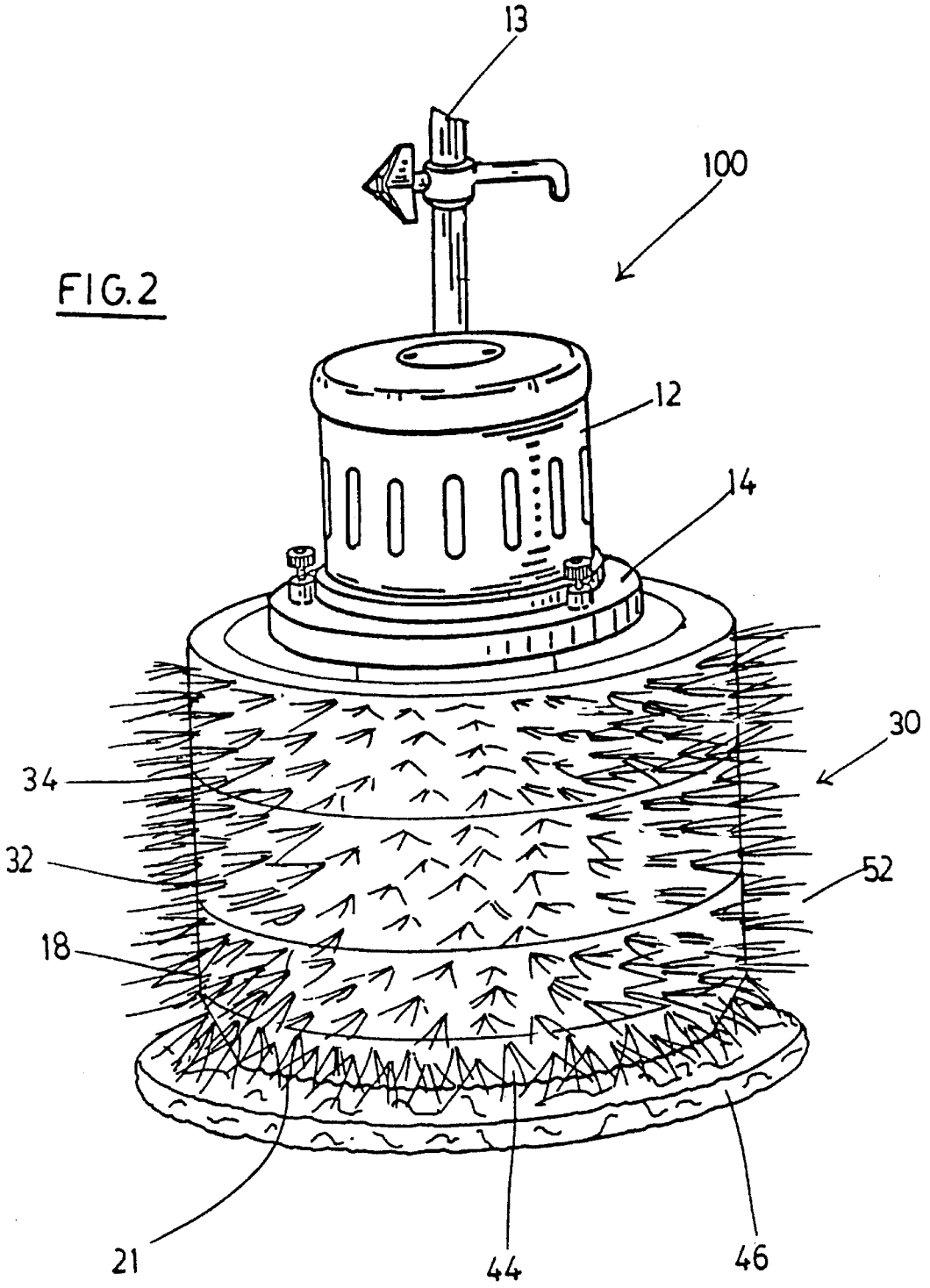
FIG. 2 is a view of a floor machine according to the invention having three stacked discs.

FIG. 2 shows a similar floor machine having stacked discs. Similar reference numbers to those of FIG. 1 will be used to designate similar parts. Thus, floor machine 100 comprises motor housing 12 for an electric motor. Anchor collar 14 supports housing 12. A floor treatment unit 30 is interconnectible to the drive shaft 20 of the motor.

The treatment unit comprises stacked discs 18, 32, 34. The lowermost disc 18 is the base disc, similar in all respects to the base disc of FIG. 1. The base disc 18 is connected to the next disc 32 through upper lugs 24 of the floor disc and lower lugs 36 of disc 32. Disc 32 is connected to the disc 34 by upper lugs 38 of disc 32 and lower lugs 40 of disc 34. The disc 34 is connected to the drive shaft through upper lugs 42 of disc 34 and lugs 22 of the drive shaft.

The discs 18, 32, and 34 are removable to be interchangeable with other discs and to change the number of discs used in stacking. As shown in FIG. 1, it is possible that only the base disc 18 will be used when shallow regions of the baseboard or vertical wall surface are to be cleaned.

Figure 4:
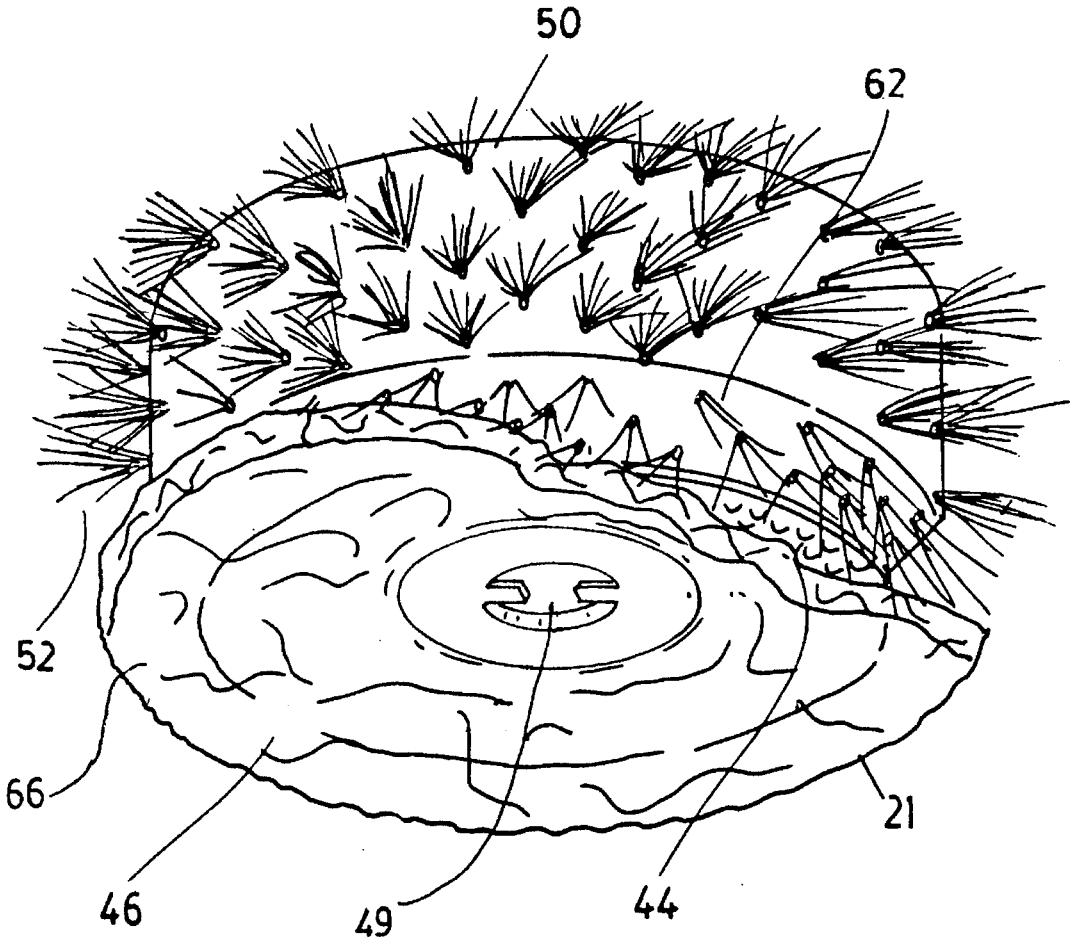
FIG. 4 is a perspective view from below of a base disc for a floor machine of FIG. 1 or FIG. 2.

As seen if FIG. 4, the floor disc 18 which may be made of cast aluminum or other material, has a flat lower surface 21 which is textured with studs, spikes or small protrusions 44. These studs, spikes or small protrusions 44 are for the purpose of digging into the surface of abrasive pad 46 located underneath floor disc 18. They may be formed in a textured plastics material sheet which is applied to the disc 18 to form its lower surface 21.

Abrasive pad 46 may be made of fibrous abrasive material or other abrasive material. It may be fastened securely to disc 18 by a conventional, centrally located screw fitting 49. Nevertheless, abrasive pads commonly in use tend to be somewhat flexible and the use of the studs or protrusions 44 guard against wrinkling or folding in use.

Figure 5:
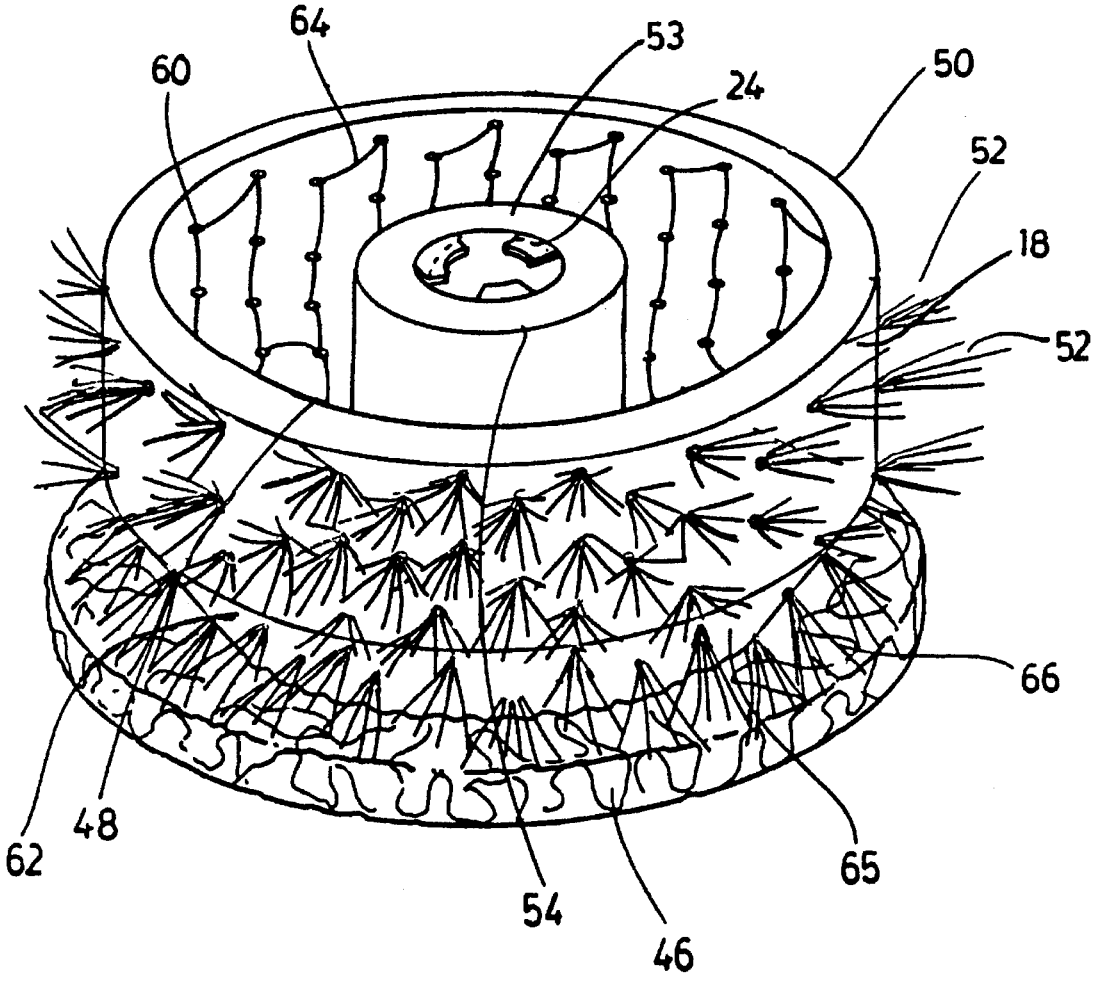
FIG. 5 is a view of a base disc (or stacked disc from above).
Figure 6:
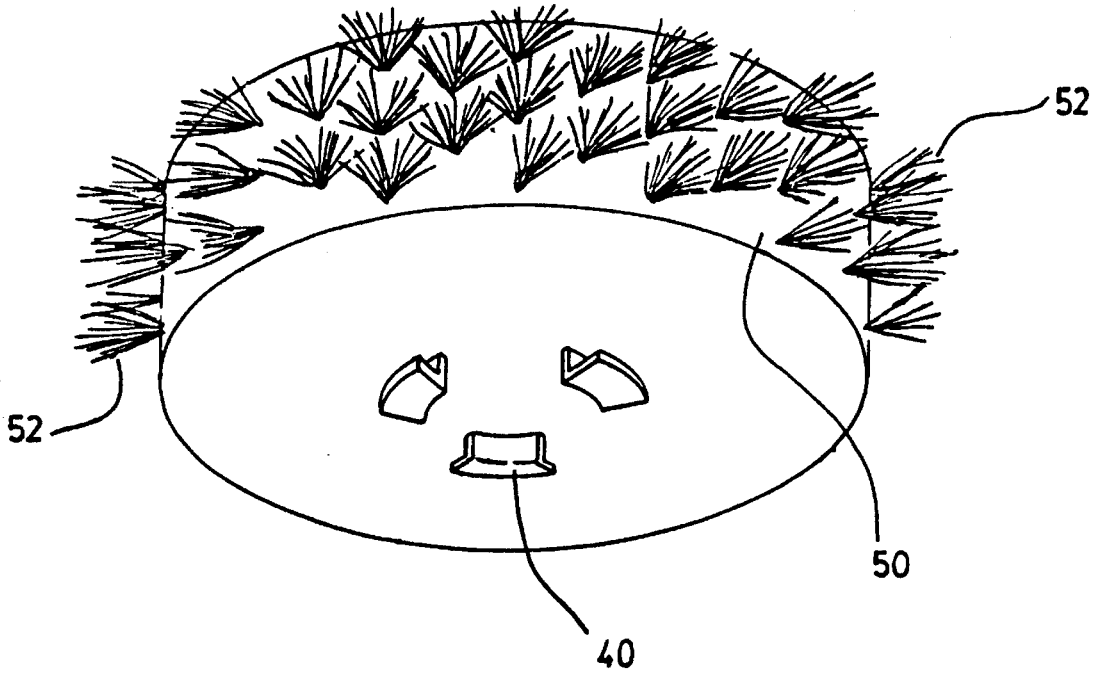
FIG. 6 is a perspective view from below of a stacked disc for a floor machine of FIG. 1 or FIG. 2.
Figure 7:
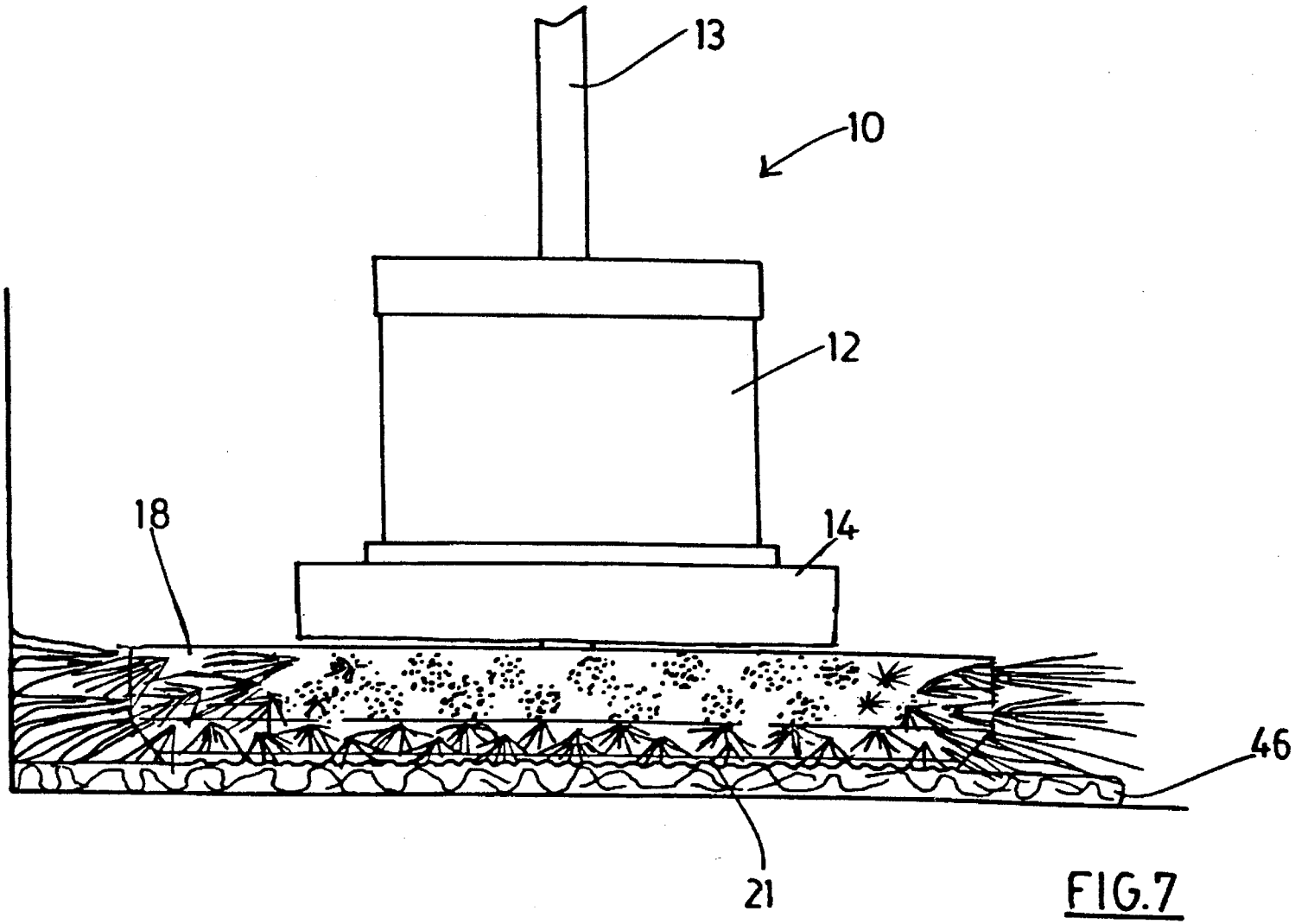
FIG. 7 is a sketch showing the floor machine in use in the angle between a floor and a vertical surface.

Disc 18 as may be seen best from FIG. 5, has a substantially flat upper surface 48 surrounded by a shallow cylindrical upstanding wall 50. Bristles 52 extend radially outwardly of the wall for the purpose of cleaning baseboard. In the centre of upper surface 48 of disc 18 a central boss 54 stands upwardly to substantially the same height as the wall 50. In an indentation of the upper surface 53 of the boss 54 there are arranged three upper floor lugs 24 which interengage with lower lugs in the disc immediately above it.

The various engagement upper lugs 24, 38, 42 and lower lugs 36, 40 and drive shaft lugs 22 may be of any convenient form, for example, as shown in U.S. Patent Application 08/180,905, now U.S. Pat. No. 5,432,970. Alternatively they may be as shown herein where lower lugs depend from a surface to project into the indentation in boss 54 and, on turning of their disc, latch behind upper lugs projecting laterally into the indentation in boss 54. Conveniently, the upper lugs slope about the circumference of the indentation so that they form partial screw thread into which the upper lugs may be screwed to tighten one disc against the another. Alternatively, either the lower lugs or upper lugs have stop surfaces to present turning so far that unlatching occurs again. Rotation to cause latching should be in the same direction as for floor or wall treatment so that rotation during operation does not tend to unlatch the discs.

Figure 3:
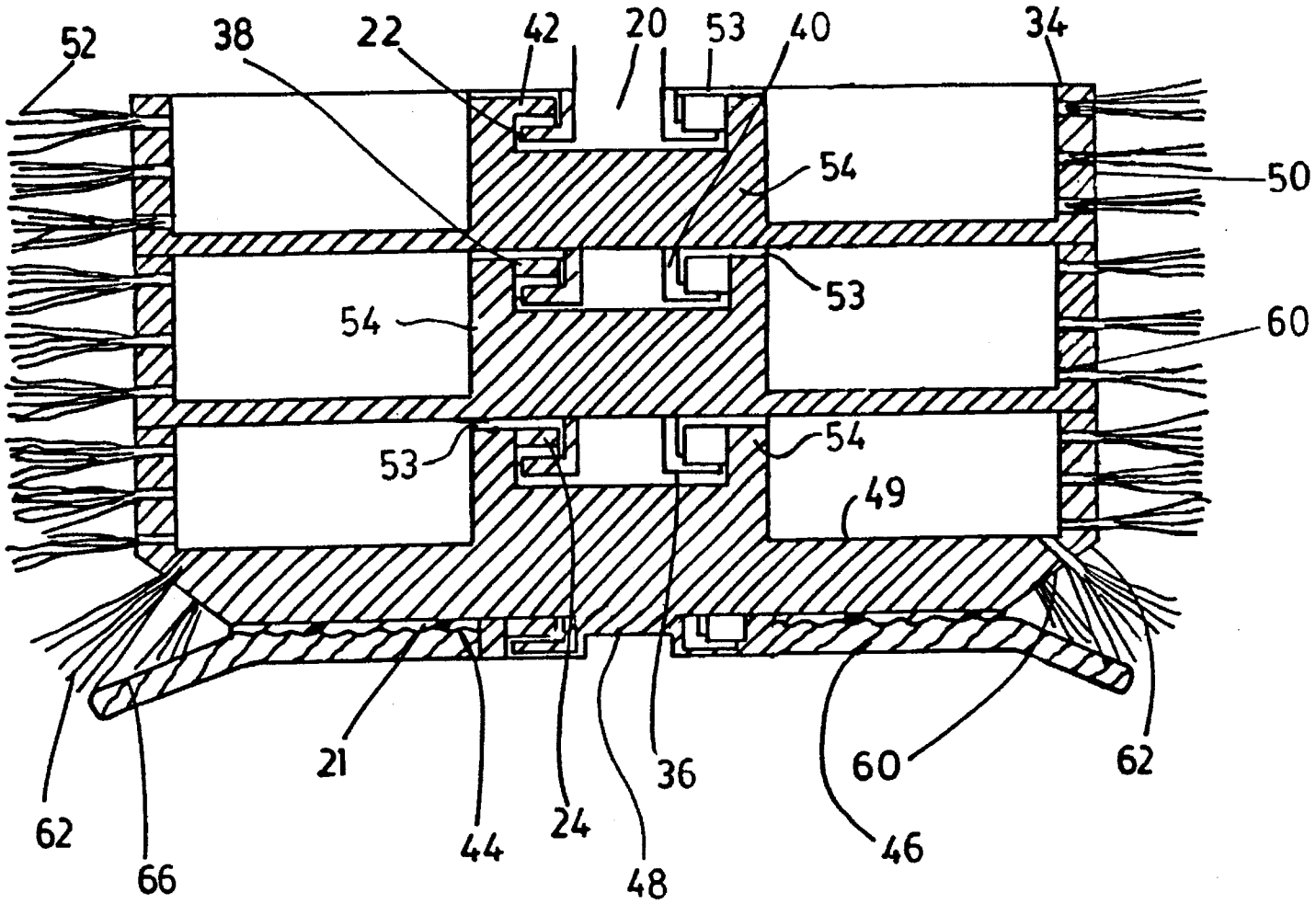
FIG. 3 is vertical section through part of the apparatus of FIG. 2 showing engagement between the drive shaft and the stacked discs.

Discs 32 and 34 as shown in FIG. 2 and 3 are identical with one another and differ only from the floor disc 18 at their lower surface. The lower surface of discs 32, 34 is provided only with lower lugs 36, 40 to engage upper lugs 24 of disc 18 or upper lugs 38 of disc 32. The relative vertical locations of upper lugs 24 of disc 18 and upper lugs of disc 34 are such that, when the lugs are engaged, disc 34 rests firmly on disc 18. Similarly, disc 34 is connected, on the one hand, to disc 32 and, on the other hand, to drive shaft 20.

All the discs 18, 32, 34 are provided with a shallow upstanding cylindrical wall 50. Bristles 52 may be set into this wall 50 to extend radially therefrom in any convenient manner as shown in FIGS. 1–7 but other cleaning means may be provided against wall 50. Bunches of bristles 52 may be located in drill holes 60 of the wall. The bristles may be formed into in bunches in any convenient manner and each bunch is wired to an adjacent bunch by wires 64 passing through the drill holes and forming a lacing on the inside of wall 50.

With further reference to FIGS. 2, 3 and 4 it may been seen that floor disc 18 differs from discs 32 and 34 by the provision of a bevelled surface 62 between the wall 50 and the under surface. This bevelled surface has bristles 52 projecting from it at right angle so that they project slightly downwardly as well as radially. The pad 46 has a circumference such that it extends under the bristles and, preferably, the pad has a circumference generally coincident with the outer most circumference of the floor disc 18 inclusive of the length of bristles 52.

These slightly downwardly extending bristles from bevelled surface 62 push a peripheral margin 66 of the pad downwardly. Thus, there is a tendency for the pad and the downwardly extending bristles 52 to be directed into any angle between a floor to be cleaned and a vertical surface rising from it such as baseboard. It is believed that the bevelled surface 62 should rise outwardly from the lower surface of disc 18 at an angle of approximately 20° to said lower surface and to the floor. It is, however, possible that the angle of the bevelled surface should be greater or even less than this.

The device, in operation may be used to clean baseboard using the bristles, and to clean floor using the floor pad 46. In the angle between floor and baseboard the downwardly extending bristles 52 and pad margin 66 will be forced into a more flattened configuration by the weight of the device on the floor (See FIG. 7) thus, there will be increased pressure and bulk of cleaning material being forced into the angle between floor and the baseboard.

Figure 8:
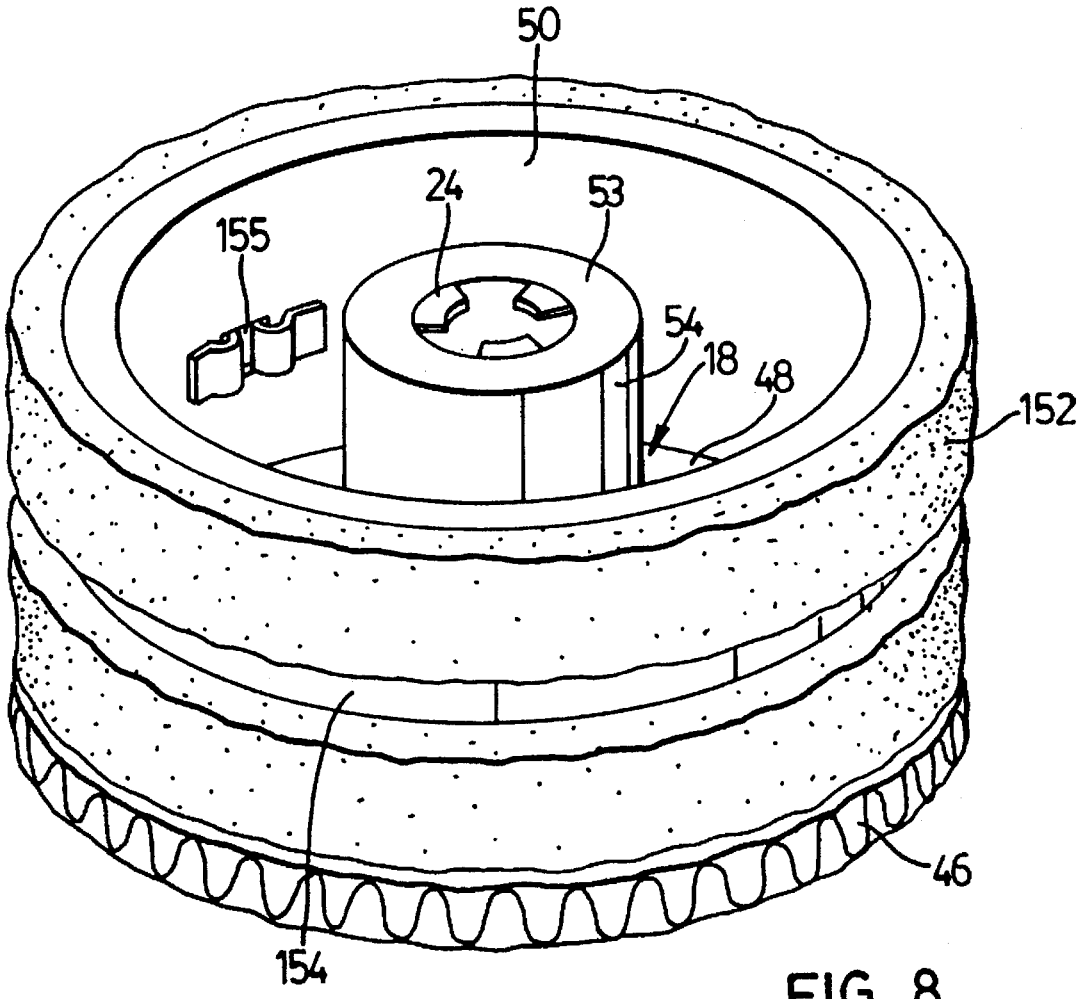
FIG. 8 shows a disc having baseboard cleaning means comprising a felted abrasive pad.

FIG. 8 shows a disc having a different means for cleaning baseboard than the bristles described above.

In the modification of FIG. 8, disc 18, as in the previous embodiment, has a substantially flat upper surface 48 surrounded by a shallow cylindrical upstanding wall 50. A wrap-around felted abrasive pad strip 152 extends radially outwardly of the wall 50 for about 3 ½ to 4 inches for the purpose of cleaning baseboards. The strip 152 is separate from the floor treatment pad 46. In the centre of upper surface 48 of disc 18, a central boss 54 stands upwardly to substantially the same height as the wall 50. In an indentation of the upper surface 53 of central boss 54 similarly to the feature shown in FIG. 5, of the boss 54 there are arranged three upper lugs 24 which interengage with lower lugs in the disc immediately above it.

The wrap-around abrasive pad 152 may be secured around wall 50 in any convenient manner. As shown a spring steel band 154 holds the pad 152 and latches firmly into an aperture 155 in the wall 50. The band 154 may, of course, be formed of other material such as plastic. While this embodiment is illustrated in respect of floor disc 18, pad 152 may be used for any of the stacked discs. If desired, a single deep pad may be used extending over more than one disc. It is not important whether a lower bevelled surface of disc 18 is present or not.

Any number of discs such as discs 32, 34 may be stacked on top of floor disc 18 according to the height of baseboard or other vertical surface which it is desired to clean.

Figure 9:
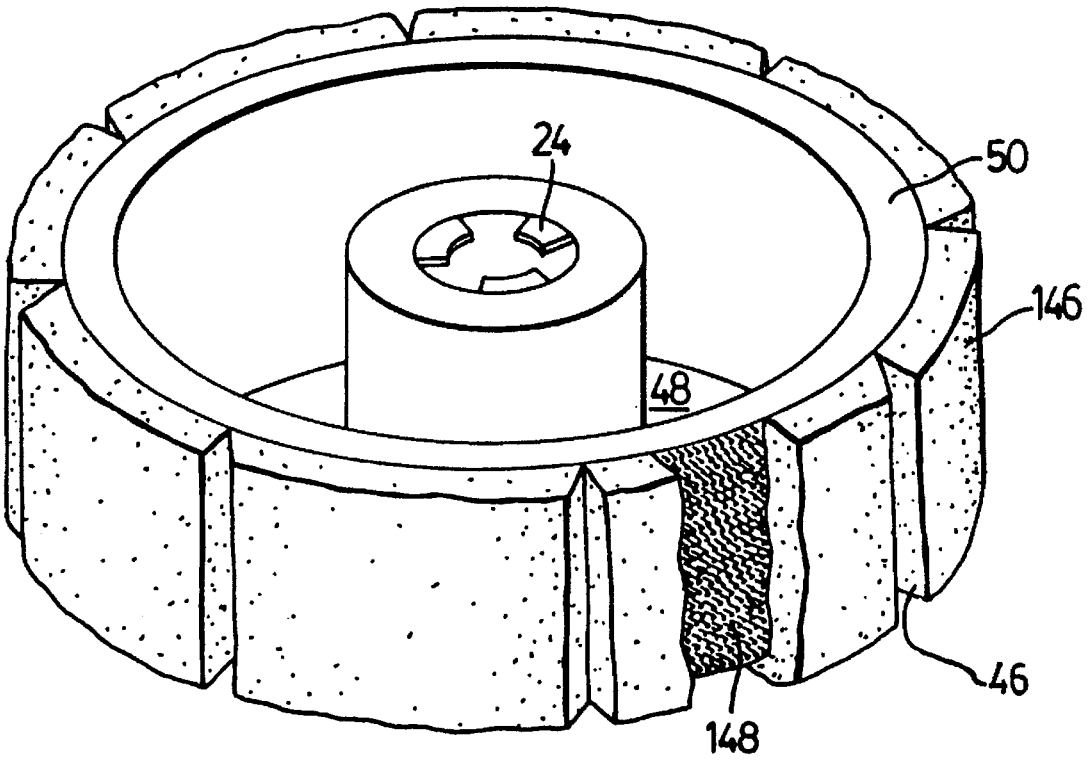
FIG. 9 shows another embodiment of a disc comprising a fitted abrasive pad.

FIG. 9 shows another disc having a different means for cleaning baseboard.

In the embodiment of FIG. 9, disc 18, as before, has a substantially flat upper surface 48 surrounded by a shallow cylindrical wall 50. As before, in the center of upper surface 48 of disc 18 a central boss stands upwardly to substantially the same height as the wall 50. Again upper floor lugs 24 are provided to interengage with lower lugs in the disc immediately above it. In this case, in the embodiment of FIG. 9, baseboard cleaning means are provided by means integral with the floor cleaning pad 46. The floor cleaning pad has a margin extending appreciably beyond the desired periphery of the treatment unit. The margin 146 is bent upwardly about the shallow cylindrical wall 50. The width of the margin 146 is chosen to conform with the height of the vertical surface or baseboard which it is desired to clean. If it is desired to clean different heights of vertical surface, the floor cleaning pad may be changed for one with a different margin. The bent up margin 146 may be secured to the shallow cylindrical wall by the hook part 148 of hook and loop fastening such as Velcro (Trade-Mark). It is not necessary to provide any loop part since the felting of the abrasive felted pad acts as such looped part and may engage securely with the hooked surface 148 which is provided over the outer surface of wall 50. Conveniently, margin 146 is provided with cut out portions 147 so that it may be turned up about wall 50 without overlapping or creasing.

Figure 10:
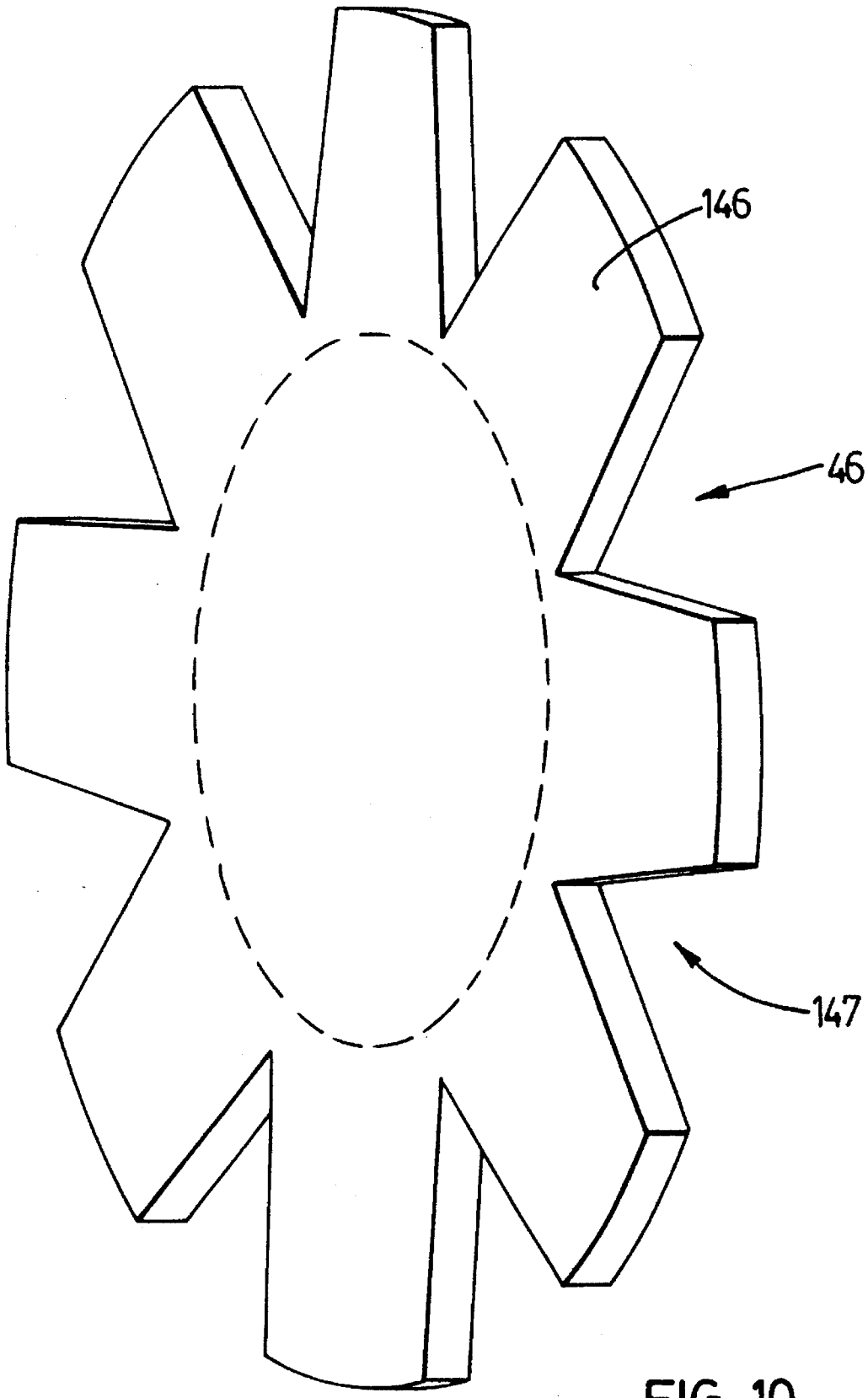
FIG. 10 shows the abrasive pad of FIG. 9 unwrapped from its disc.

Integral abrasive floor pad 46 having margin 146 to be turned up about wall 50 is shown in FIG. 10.

Figure 11:
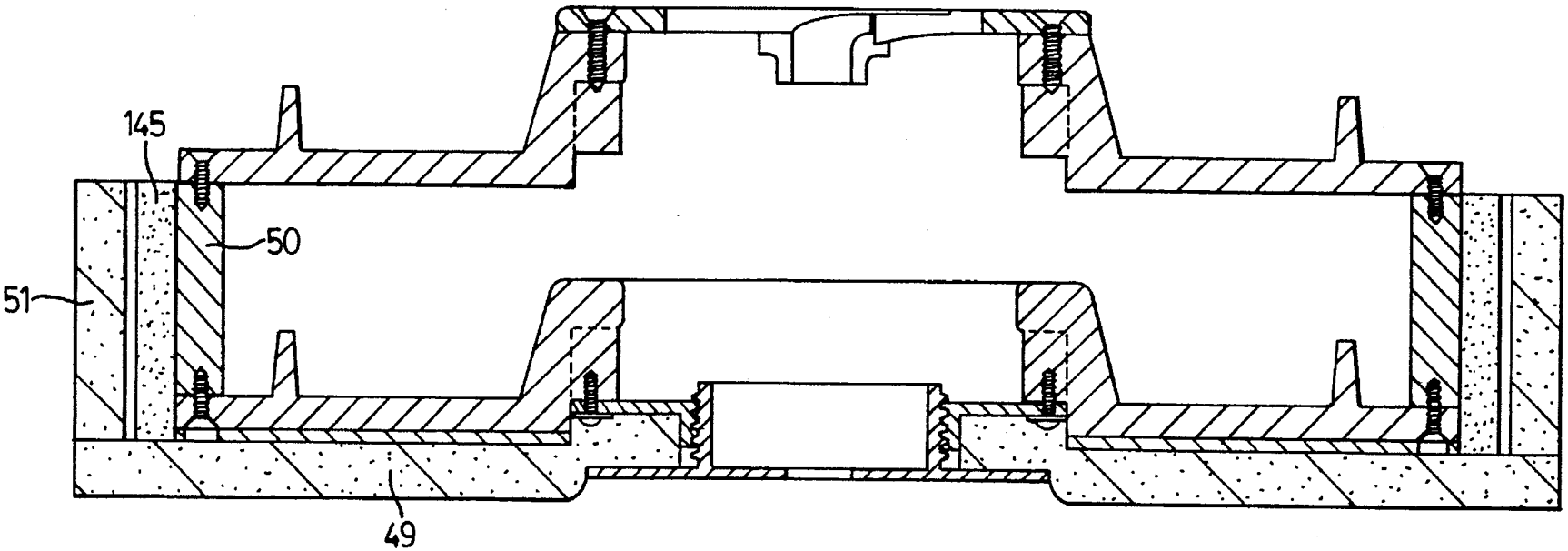
FIG. 11 is a section showing a modification of the pad of FIGS. 9 and 10.

FIG. 11 shows a Somewhat similar floor pad to that of FIGS. 9 and 10. The pad of FIG. 11 is formed in two parts comprising a flat floor disc pad 49 and a cylindrical wall pad disc 51 attached to wall 50 by the hook part 145 of hook and loop fastening. This embodiment may allow better access to the angle between floor and wall than does the embodiment of FIGS. 9 and 10.

Figure 12:
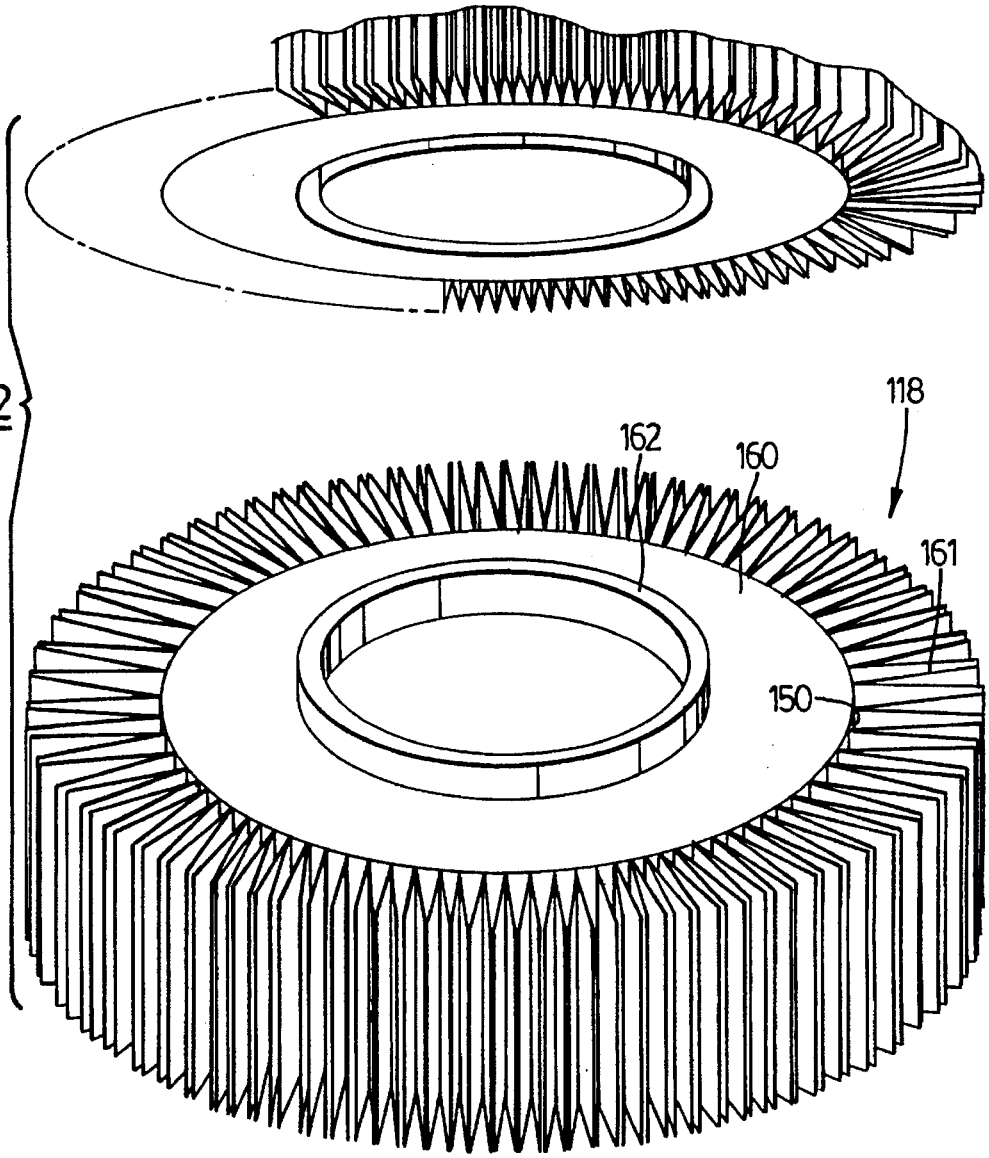
FIG. 12 shows another embodiment of a cleaning disc for cleaning both vertical and floor surfaces.

FIG. 12 shows yet another embodiment of a disc 118 which may be a moulded epoxy having embedded fabric flaps about its periphery. In operation the flaps flail against the vertical surface to clean it.

Disc 118 shown in FIG. 12 has an upper surface 160, a lower surface and upstanding cylindrical wall between the surfaces. The disc 118 may be made of epoxy resin and fabric flaps 161 may be embedded radially around and into wall 150. The engagement means between this disc and a disc immediately above it may be through a raised ridge 162 which seats in a groove on the lower surface of the disc above it. Disc 118 is intended as a stacking disc but it may be provided with engagement lugs on either its upper surface for engagement with a drive shaft of the floor machine or on its lower surface for engagement for another disc. It is envisaged that this disc does not need tight engagement through the lugs of the other discs so far described but may function quite effectively by flailing fabric flaps 161 when ridge 162 is engaged in a complementary groove of the next disc.

Figure 13:
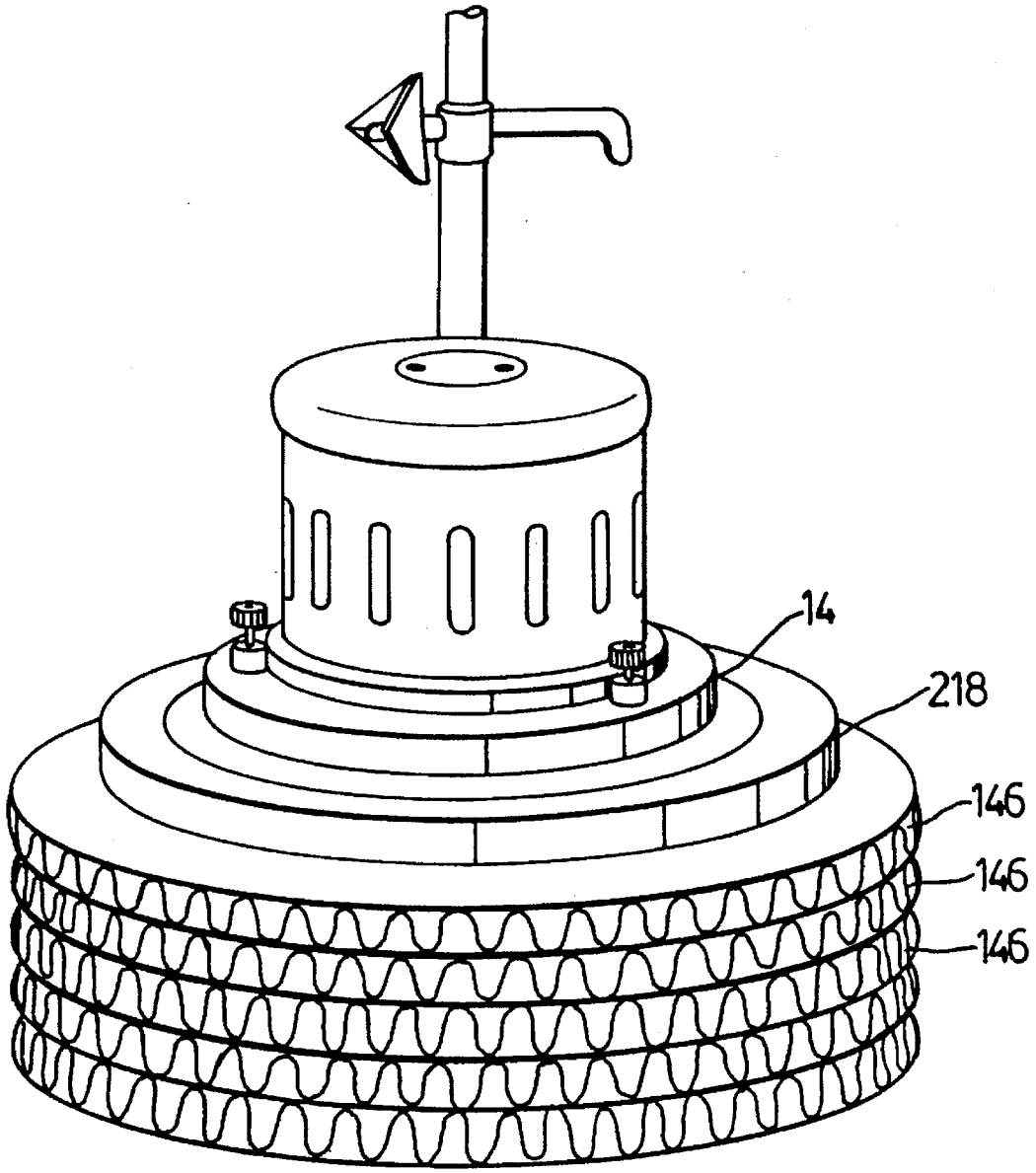
FIG. 13 shows yet another means of cleaning both vertical and floor surfaces.

FIG. 13 shows yet another means of cleaning both vertical and floor surfaces using abrasive pads. The abrasive pads 146 may, themselves, be stacked below anchor collar 14 and a base disc 218. The circumferences of the stacked pads 146 are all the same so that the stacked pads form a cylinder having a vertical wall. Moreover, the circumferences of the stacked pads 146 are greater than the circumference of base disc 218 and anchor collar 14 so that they extend radially from base disc 218. A potential advantage of this alternative embodiment is that by stacking different number of pads 146 it may be relatively easy to accurately determine the height of the vertical surface to be cleaned. The stack may be held in position by a bolt therethrough similarly to the manner in which a single pad is held. Base disc 218 may be provided with a lower surface having stud, spikes or other protrusions to hold the top most pad in position against the disc. The other pads, due to their felting and roughened fibres will tend to hold in place against one another.

We claim:

1. A floor machine for treating a floor and vertical surface adjacent the floor comprising:

a rotatable floor and vertical surface treatment unit for treating said floor and said vertical surface adjacent the floor;

a drive shaft coincident with a central axis of the unit;

engagement means between the treatment unit and the drive shaft;

the treatment unit comprising:

a floor disc having an upper disc surface and a lower disc surface, a shallow cylindrical vertical wall being upstanding from the floor disc; a floor treatment pad being attached to the lower disc surface, the pad having an upper pad surface flush with said lower disc surface; and vertical surface cleaning means extending radially outwardly from said cylindrical vertical wall for cleaning said vertical surface adjacent the floor;

the engagement means between the drive shaft and the treatment unit comprising a plurality of drive shaft lugs on the drive shaft engaging a corresponding plurality of mating unit lugs on the treatment unit.

2. A floor machine as claimed in claim 1 in which the unit lugs are floor disc lugs located on a boss projecting above the upper disc surface of said disc.

3. A floor machine as claimed in claim 1 in which the treatment unit comprises said floor disc and a stacked disc stacked above it, said stacked disc having a lower surface, and upper surface, a shallow cylindrical vertical wall being upstanding from the upper surface of the stacked disc and baseboard cleaning means extending radially from the shallow cylindrical vertical wall upstanding from the stacked disc, lugs being provided on the stacked disc located on a boss projecting above the upper surface of said stacked disc to constitute said unit lugs; disc engagement means being provided between said stacked disc and said floor disc, the disc engagement means comprising a plurality of lower, stacked disc lugs projecting beneath said stacked disc and a corresponding plurality of interengagable floor disc lugs located on a boss projecting above the upper surface of the floor disc.

4. A floor machine as claimed in claim 3 in which at least one further stacked disc is interposed between the floor disc and said stacked disc, the further stacked disc engaging With discs stacked above and below it.

5. A floor machine as claimed in claim 1 in which the vertical surface cleaning means comprises bristles.

6. A floor machine as claimed in claim 5 in which the floor disc is provided with a bevelled surface between the shallow vertical wall and the lower surface, bristles extending from the bevelled surface at right angles thereto.

7. A floor machine as claimed in claim 6 in which the bevelled surface extends outwardly and upwardly from the lower surface at substantially 20° thereto.

8. A floor machine as claimed in claim 6 in which a margin of the floor pad extends under bristles extending from the bevelled surface.

9. A floor machine as claimed in claim 1 in which the lower surface of the floor disc is studded for intimate contact with the floor pad.

10. A floor machine as claimed in claim 1 in which the vertical surface cleaning means is an abrasive felted pad wrapped circumferentially around said shallow cylindrical wall and removably secured thereto.

11. A floor machine as claimed in claim 10 in which the vertical surface cleaning means is separate from the floor treatment pad and comprises an abrasive pad strip wrapped about the shallow cylindrical wall.

12. A floor treatment machine as claimed in claim 11 in which at least one circumferential strap about the abrasive felted pad and the shallow cylindrical wall is used to secure said abrasive pad strip.

13. A floor machine as claimed in claim 12 in which the vertical surface cleaning means is integral with the floor treatment pad and comprises a margin of the floor treatment pad upturned about the circumference of the shallow cylindrical wall.

14. A floor machine as claimed in claim 13 in which the vertical surface cleaning means is secured to the shallow cylindrical wall by a hooked portion of hook and loop fastener.

* * * * *